US006076566A

United States Patent [19]

Lowe

[11] Patent Number: 6,076,566

[45] Date of Patent: Jun. 20, 2000

[54] BRACKET FOR SUSPENDING PRESSURE SEAL BAGS

[76] Inventor: Darrell E. Lowe, 137 Napoleon Rd., West Monroe, La. 71291

[21] Appl. No.: 09/103,151

[22] Filed: Jun. 22, 1998

[51] Int. Cl.[7] ..... B65B 1/04

[52] U.S. Cl. ..... 141/10; 141/314

[58] Field of Search ..... 141/10, 114, 313, 141/314, 316, 390, 391; 248/95, 99

[56] References Cited

U.S. PATENT DOCUMENTS

| | | | |
|---|---|---|---|
| 4,620,681 | 11/1986 | Staley | 248/95 |
| 4,664,348 | 5/1987 | Corsaut | 248/99 |
| 4,832,292 | 5/1989 | Beckham | 248/99 |
| 5,014,943 | 5/1991 | Nelson | 248/99 |
| 5,323,990 | 6/1994 | Graves | 248/97 |
| 5,597,022 | 1/1997 | Reifers | 141/390 |
| 5,641,138 | 6/1997 | Cronk | 248/99 |

*Primary Examiner*—Steven O. Douglas
*Assistant Examiner*—Peter deVore
*Attorney, Agent, or Firm*—John M. Harrison

[57] ABSTRACT

A bracket for mounting on a supporting object or support and receiving and suspending pressure seal or closure bags in open configuration, which bracket typically includes a generally elliptically-shaped frame fitted with a flange along one edge, the flange extending from the edge of the bracket and having an upwardly-projecting flange lip for mounting the bracket on a support such as the dash of an automobile, a cabinet, desk, or the like. The bracket is designed to suspend an open, tab-and-slot, pressure seal bag as a receptacle for trash and other articles, wherein the reversed tab-and-slot pressure seal elements in the mouth of the bag engage the outside periphery of the bracket frame at a bag fold and secure the pressure seal plastic bag on the bracket.

1 Claim, 2 Drawing Sheets

BRACKET FOR SUSPENDING PRESSURE SEAL BAGS

BACKGROUND OF THE INVENTION

Field of the Invention

This invention relates to brackets and frames for mounting and suspending trash bags and other bags in open configuration for containing trash and various objects and material. More particularly, the invention is characterized by a bracket for mounting on a supporting object and suspending pressure-seal or closure type plastic bags having linear tab-and-slot or zipper-type closure or engaging elements in the bag mouth, which bracket typically includes a generally elliptically-shaped frame fitted with a flange and flange lip for attaching the frame to a fixed object such as a cabinet, automobile dash, desk or the like. The frame is designed to receive a pressure-seal or closure bag such as a "Ziplock" (trademark) or zipper closure bag and suspend the bag as a receptacle for trash or other articles, such that the bag may be quickly and easily placed on and removed from the bracket and pressure-sealed when filled, for disposal or other use, as desired. The upwardly-extending flange lip in the frame flange is typically spaced from one edge of the bracket frame and is designed to mount on a vertical surface, thus positioning the bracket frame of the bracket in a substantially horizontal configuration to receive the top edge or mouth of a reverse-opened plastic bag. The plastic bag is then again reversed on itself as it is deployed through the opening in the bracket frame to assume its original shape, which action suspends the bag at a bag fold wherein the pressure seal elements engage the outside periphery of the bracket frame.

One of the problems which exists in utilizing various types of brackets, hangers and suspending mechanisms for suspending and supporting trash bags and other bags in open configuration, is that of securing the bag in removable fashion on the bracket, suspender or other device without the necessity of using a clip, ring or other keeper in association with the bracket. This problem is particularly apparent under circumstances where it is desired to suspend a pressure seal-type bag such as a "Ziplock" (trademark) or zipper closure bag, because the stiffness of the sealing elements at the bag mouth makes it difficult to mount the bag and maintain it in a secure, open configuration on a bracket or other suspension device.

Various devices are known for suspending trash bags and other bags from brackets and other support members. Typical of these devices is the apparatus for receiving empty beverage cans detailed in U.S. Pat. No. 4,620,681, issued Nov. 4, 1986, to Ellis J. Staley III, et al. The apparatus is designed to receive empty beverage cans and includes a bag having multiple closure bands positioned about the periphery of the bag mouth and an annular support member having multiple corners provided with downwardly-curved slits extending through the thickness of the annular member on each side of the corners. The closure bands of the bag may be drawn over the upper edge of the annular member and slipped into and upwardly within one of the slits, causing the ends of the slits to grip the closure bands on each side of the corners. U.S. Pat. No. 4,664,348, dated May 12, 1987, to Otho O. Corsaut III, et al, details a "Bag Holder", which includes a flexible plastic strip having an intermediate straight portion adapted for insertion within a trash bag opening for alternative ground or floor engagement or wall hanging, with a bag retained in open receiving configuration. U.S. Pat. No. 4,832,292, dated May 23, 1989, to William T. Beckham, details a "Method and Apparatus For Holding A Trash Bag". The apparatus has a perimeter for holding the bag open, a curved rim on one side of the perimeter for retaining the bag and gripping when lifting the bag and a flattened portion of the perimeter for engaging a surface. The flattened portion has a protruding lip opposite the curved rim for standing the apparatus upright and acting as a receiving ramp for sweeping into the bag. U.S. Pat. No. 5,014,943, dated May 14, 1991, to Dean O. Nelson et al., details a "Trash Bag Holder" which includes a hook that is collapsed to fit in the mouth of a trash bag and then expanded to open the bag for filling with trash. A pan is attached to the hook and serves both as a threshold when sweeping trash into the bag, and as a lid when the bag is used as a trash receptacle. U.S. Pat. No. 5,323,990, dated Jun. 28, 1994, to David A. Graves, details a "Leaf Ramp and Bag Holder Device" which includes a blunt-nose ramp upon which leaves are raked. When the leaves are raked to the top of the ramp they fall by gravity through an opening provided in the device, either into a trash bag secured to the opening or into a free-standing trash receptacle. The rear leg provided on the device anchors the device to the ground and a rest is provided at the front end of the device to secure the device against the ground while it is in use. U.S. Pat. No. 5,597,022, dated Jan. 28, 1997, to Richard F. Reifers, details a "Device For Loading Trash Bags". A loading ring is provided for receiving a trash bag, which ring is periodically manually shifted upwardly, thus causing the enclosed trash and refuse to drop by gravity further into the bag as the bag is filled. A "Trash Bag Stand" is detailed in U.S. Pat. No. 5,641,138, dated Jun. 24, 1997, to Leon Cronk, et al. The trash bag stand includes a lip ring, a stand fastener, a bag-securing mechanism, a drop and a bag dispenser. The stand fastener fastens the lip ring to a support structure and the bag-securing mechanism includes a securing ring for securing the bag lip to the lip ring and the bag therebetween. The drop extends from the ring a distance substantially equal to the length of the bag to an end and the bag-dispenser is located at the end of the ring. The bag-dispenser receives multiple bags for serial dispensing onto the ring.

It is an object of this invention to provide a continuous frame bracket for suspending zipper closure and pressure-seal-type bags, such that trash and other objects may be placed in the bags and when the bags are full, they may be released from the bracket and pressure-sealed for further disposition.

Another object of this invention is to provide a new and improved, preferably generally elliptically-shaped bracket adapted for horizontal mounting on a support or object and shaped to receive a zipper closure or tab-and-slot, linearly-sealed plastic bag, such that the bag is first reversed-opened, the mouth and sealing elements fitted over the bracket and the bag then deployed through the center of the bracket to assume its original shape and facilitate suspension of the bag on the bracket by its upper lip or edge at the sealing elements in open configuration, for filling the bag with trash or other objects.

Still another object of this invention is to provide a bracket for suspending zipper-type and tab-and-slot, pressure-seal or closure bags for receiving trash or other objects. In a preferred embodiment the bracket is characterized by a continuous bracket frame fitted with a flange typically having a flange lip spaced from a bracket side for mounting the bracket frame on a fixed object or support in substantially horizontal orientation. The bracket frame is designed to receive the mouth and sealing elements of the plastic bag, wherein the plastic bag is initially reverse-opened inside and out, the reversed mouth of the bag inserted over the bracket frame at the sealing elements and the bag then deployed through the center of the bracket frame. This configuration facilitates suspension of the bag in its original open shape on the frame by a fold at the sealing elements such that the reversed sealing elements tighten on the outside periphery of the bracket frame as the plastic bag is loaded.

Another object of this invention is to provide a method for suspending pressure-seal or closure-type bags from a bracket having a mount flange, which method includes the steps of mounting the bracket on a support in substantially horizontal configuration by means of the mount flange, reversing the bag inside-out, positioning the reversed mouth and the sealing elements of the plastic bag around the periphery of the bracket, deploying the plastic bag through the opening in the bracket to its original shape and creating a fold in the bag mouth with the sealing elements disposed around the outside periphery of the bracket to further deploy the bag beneath the bracket for filling with various objects.

SUMMARY OF THE INVENTION

These and other objects of the invention are provided in a new and improved bracket for receiving and mounting tab-and-slot, pressure-seal or closure bags of the "Ziplock" (trademark) design, which bracket includes, in a preferred embodiment, a generally elliptically-shaped bracket frame having a continuous curved or radiused top edge and a flange provided along one edge of the bracket, the flange typically defining a flange lip spaced from an edge or leg of the bracket frame for attachment to a fixed object or support and suspending the bracket frame in substantially horizontal configuration. The plastic bag is first reversed inside-out, the reversed mouth then placed over the bracket frame at the reversed bag sealing elements and the bag is then deployed through and suspended from the bracket frame in its original configuration with the sealing elements and bag mouth folded over the bracket frame, such that the sealing elements engage the outside periphery of the bracket frame and tighten on the bracket frame as the bag is loaded. However, the plastic bag may be easily removed from the bracket frame and sealed when the bag is full.

Another object of the invention is to provide a method for suspending a zipper closure or pressure-seal-type bag from a horizontally-disposed, typically elliptically-shaped bracket, which method includes the steps of mounting the bracket on a support in substantially horizontal configuration, reverse-opening the plastic bag, placing the reversed mouth of the plastic bag around the periphery of the continuous bracket frame at the likewise reversed sealing elements and deploying the plastic bag through the opening in the bracket frame to define a fold at the bag sealing elements, wherein the sealing elements are disposed around the curved or radiused outside top edge of the bracket frame, thus tightening on the bracket frame as trash or various objects are loaded in the plastic bag.

BRIEF DESCRIPTION OF THE DRAWINGS

The invention will be better understood by reference to the accompanying drawings, wherein.

DESCRIPTION OF THE PREFERRED EMBODIMENTS

Figure 1:
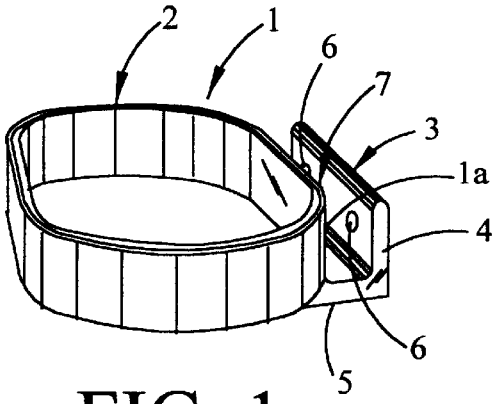
FIG. 1 is a perspective view of a preferred embodiment of the bracket for mounting on a support and suspending pressure-seal bags of this invention.
Figure 2:
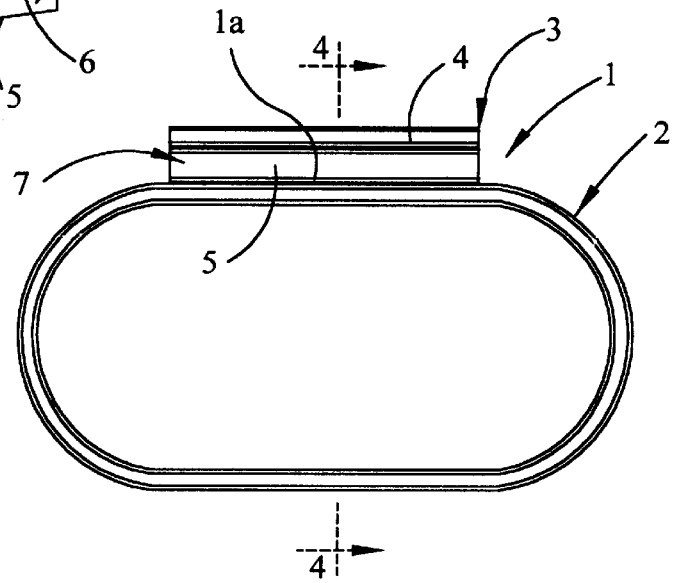
FIG. 2 is a top view of the bracket illustrated in FIG. 1.
Figure 3:
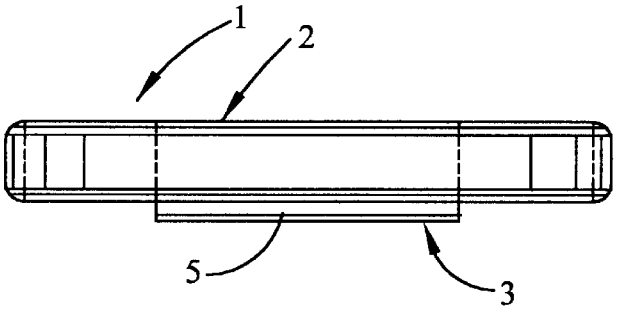
FIG. 3 is a front view of the bracket illustrated in FIGS. 1 and 2.
Figure 4:
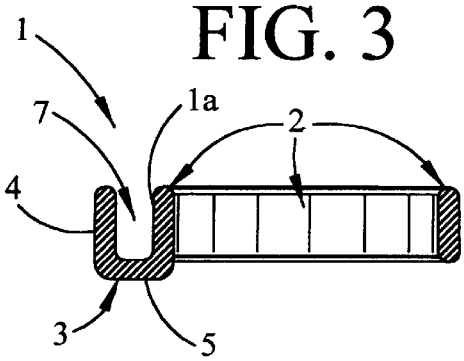
FIG. 4 is a sectional view, taken along line 4—4 of the bracket illustrated in FIG. 2.
Figure 4A:
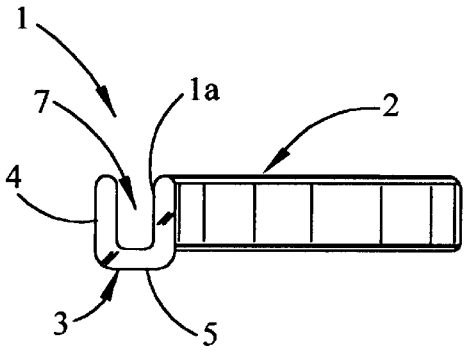
FIG. 4A is a side elevation of the bracket illustrated in FIG. 1.

Referring initially to FIGS. 1–4A of the drawings, in a preferred embodiment the bracket for suspending pressure seal bags of this invention is generally illustrated by reference numeral 1. The bracket 1 is typically characterized by a continuous, generally elliptically-shaped bracket frame 2, which may be constructed of metal, plastic, fiberglass or other material well known to those skilled in the art. A frame flange 3 extends from a bracket edge 1*a* of one leg or side of the bracket frame 2 and includes a flange base 5, projecting outwardly from the bracket edge 1*a* of the bracket frame 2 and an upward-standing flange lip 4 extends upwardly from the flange base 5 and is spaced from the bracket edge 1*a*, to define a lip channel 7 between the flange lip 4 and the upward-standing bracket edge 1*a* of the bracket frame 2. It will be appreciated by those skilled in the art that the flange lip 4 may be provided with fastener openings 6, illustrated in FIG. 1, and secured by means of fasteners (not illustrated) to a fixed object or support such as a cabinet, wall, automobile dashboard, desk or like object (also not illustrated) for orienting the bracket frame 2 in a substantially horizontal configuration and suspending a linearly-sealable plastic bag therefrom, as hereinafter described.

Figure 5:
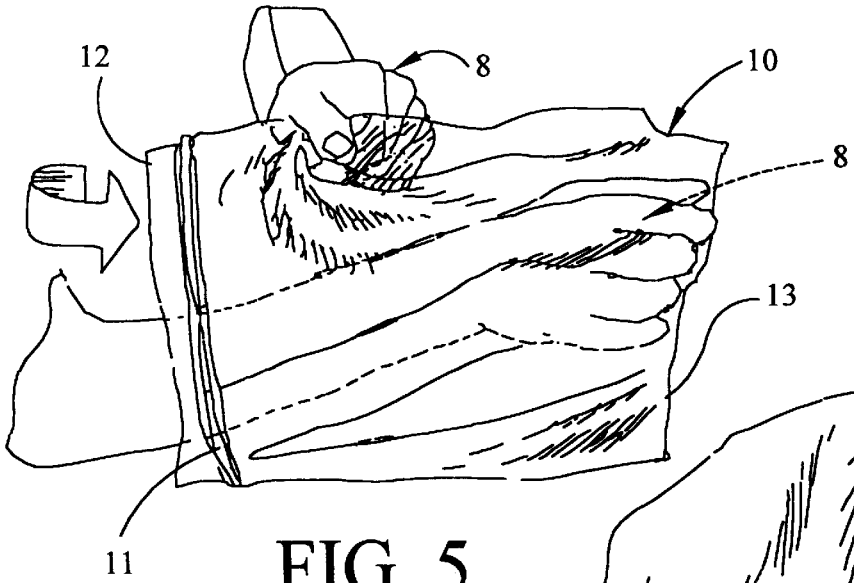
FIG. 5 is a perspective view of a typical reverse-opened, inside-out orientation of a tab-and-slot, pressure-seal type bag for suspension from the bracket illustrated in FIGS. 1–4.

Referring now to FIG. 5 of the drawings, a conventional pressure seal or closure bag 10 is illustrated, which pressure seal bag 10 is initially reversed inside-out for application to and suspension from the bracket 1 illustrated in FIGS. 1–4. The pressure seal plastic bag 10 is typically characterized by conventional tab-and-slot pressure-seal elements 11, spaced in parallel relationship from the top edge or mouth 12 thereof, and the pressure seal plastic bag 10 further defining a sealed bottom 13. Alternatively, the pressure seal bag 10 may be of the zipper closure design well known to those skilled in the art. The pressure seal bag 10 is initially opened by the hand 8 of a user, as further illustrated in FIG. 5.

Figure 6:
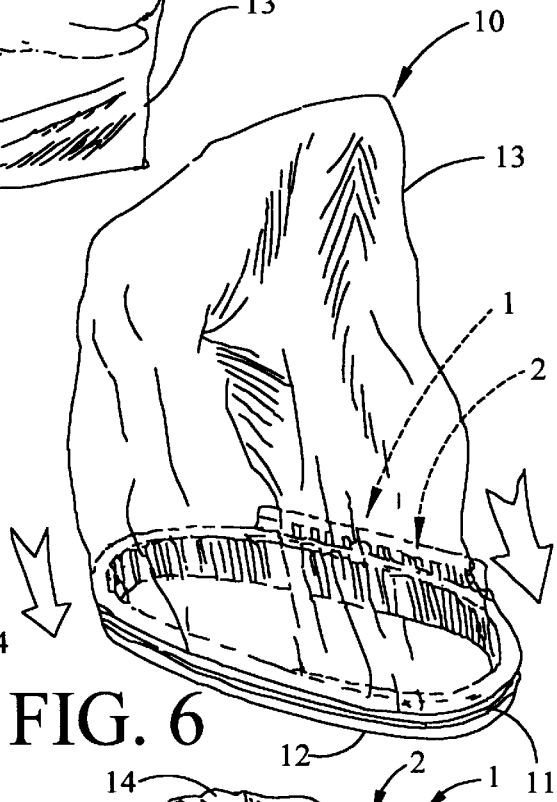
FIG. 6 is a perspective view of the reverse-opened plastic bag illustrated in FIG. 5 positioned with the reversed top edge or mouth and sealing elements engaging the horizontally-disposed bracket illustrated in FIGS. 1–4.

Referring to FIG. 6 of the drawings, the mouth or top edge 12 of the reverse-opened pressure seal bag 10 illustrated in FIG. 5 is then fitted around the periphery of the bracket frame 2, as illustrated, wherein the reversed pressure seal elements 11 also extend around the periphery of the bracket frame 2. Accordingly, when in this configuration, the pressure seal bag 10 is essentially open in upside down, inside-out configuration, with the mouth or top edge 12 and pressure seal elements 11 removably encircling the outside periphery of the continuous bracket frame 2 in a snug fit.

Figure 7:
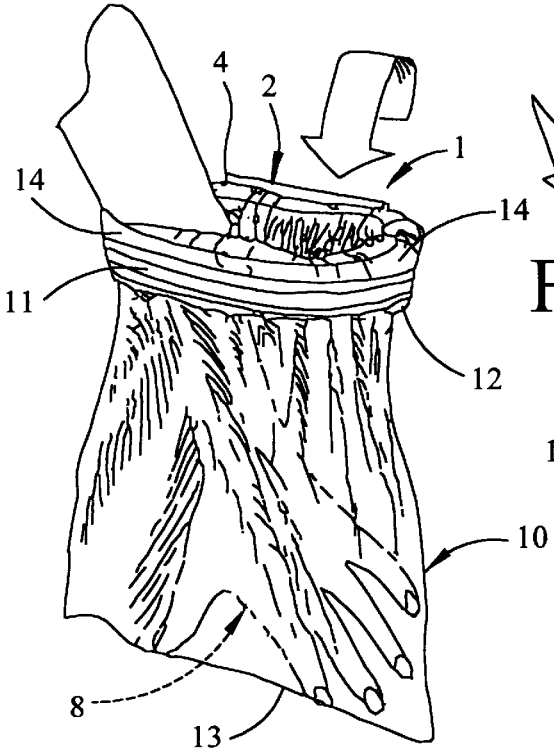
FIG. 7 is a perspective view of a typical deployment of the plastic bag illustrated in FIG. 6 downwardly through the opening defined by the bracket frame of the bracket illustrated in FIG. 6 to its original configuration.

Referring now to FIG. 7 of the drawings, the sealed bottom 13 of the pressure seal bag 10 illustrated in FIG. 6 is then forced downwardly by the hand 8 through the opening defined by the bracket frame 2 and the bracket 1 to create a bag fold 14 at the top periphery of the bracket frame 2, wherein the pressure seal elements 11 are deployed around the periphery of the bracket frame 2 below the bag fold 14 to firmly, yet removably, secure the pressure seal bag 10 on the bracket frame 2, as illustrated.

Figure 8:
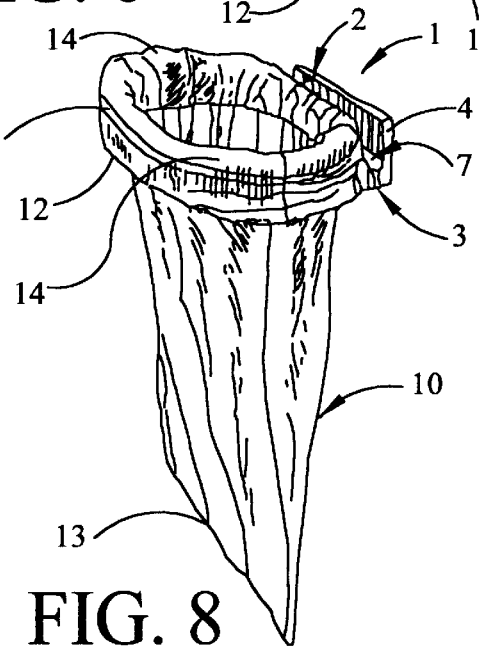
FIG. 8 is a perspective view of the open pressure seal plastic bag removably attached to the bracket frame of the bracket at the mouth and sealing elements and disposed for receiving trash or other objects.

Referring next to FIG. 8 of the drawings, it will be appreciated that the pressure seal bag 10 is firmly, yet removably, fitted to the bracket frame 2 of the bracket 1 at the bag fold 14, around the entire periphery of the continuous bracket frame 2, including that portion of the mouth or top edge 12 and the reversed pressure seal elements 11 which extend into the lip channel 7, to complete the entire peripheral grip of the pressure seal bag 10 on the bracket frame 2. When in this configuration, the pressure seal bag 10 is capable of supporting one or more heavy objects, trash, refuse and other material without fear of loosening from the bracket frame 2, since the reversed pressure seal elements 11 draw more tightly around the periphery of the bracket frame 2 to also tighten the pressure seal bag 10 at the bag fold 14, as the pressure seal bag 10 is loaded. Accordingly, one of the factors which is important in securing the pressure seal bag 10 on the bracket frame 2 of the bracket 1 is the positioning of the reversed pressure seal elements 11 tightly, yet removably, around the rounded or radiused periphery of the bracket frame 2 below the bag fold 14. Loading the pressure seal bag 10 from the bottom 13 upwardly toward the bag fold 14 thus tightens the contact between the reversed pressure seal elements 11 and the top edge 12 of the pressure seal bag 10 against the bracket frame 2, further preventing inadvertent slippage of the pressure seal bag 10 from the bracket 1.

While the bracket 1 of this invention is primarily designed to support a pressure seal bag 10 having tab-and-slot pressure seal elements 11 such as a "Ziplock" bag and similar bags, it will be appreciated by those skilled in the art that the bracket 1 will also support other plastic bags which are equipped with various similar alternative pressure seal elements 11, such as those having parallel zipper elements. Furthermore, it will also be appreciated that the continuous bracket frame 2 of the bracket 1 can be configured in substantially any dimension or shape, depending upon the size of the pressure seal bags 10 which are to be mounted on and suspended from the bracket frame 2. Moreover, the bracket 1 can be constructed of injection-molded plastics such as polyethylene and polypropylene, in non-exclusive particular, or shaped of fiberglass or metal or other materials, according to the knowledge of those skilled in the art. However, in a most preferred embodiment of the invention the bracket 1, including the bracket frame 2 and the frame flange 3, are injection-molded from a suitable plastic, to facilitate mass production and yet maintain the desired stiffness and strength required to support a pressure seal bag 10 of desired dimensions under circumstances where the frame flange 3 is attached to a fixed vertical object or support such as a desk, table, cabinet, wall or the like. Consequently, it will be further appreciated that the bracket 1 of this invention may be mounted by means of the frame flange 3 and the flange lip 4 to the dashboard of automobiles and may be of any desired size to accommodate some of the smaller pressure seal bags 10, ranging from the one pint to the one or two gallon sizes, which are available in most stores. The frame flange 3 can also be extended and the flange lip omitted to mount the bracket 1 on a horizontal surface, as desired.

While the preferred embodiments of the invention have been described above, it will be recognized and understood that various modifications may be made in the invention and the appended claims are intended to cover all such modifications which may fall within the spirit and scope of the invention.

Having described my invention with the particularity set forth above, what is claimed is:

1. A method for suspending a pressure seal bag having closure elements in the mouth thereof from a continuous bracket defining a bracket opening, comprising the steps of reversing the pressure seal bag, positioning the closure elements on the continuous bracket and extending the pressure seal bag through the bracket opening for tightening the closure element on the bracket responsive to loading of the pressure seal bag.

* * * * *